US006752079B2

(12) United States Patent
Collins et al.

(10) Patent No.: US 6,752,079 B2
(45) Date of Patent: Jun. 22, 2004

(54) MAIL RETAINING APPARATUS

(75) Inventors: Peter David Collins, Fowlmers (GB); Thomas David Reid Ford, Royston (GB); Christopher Michael Giles, Foster City, CA (US); Piers Sebastian Harding, Huntingdon (GB)

(73) Assignee: Neopost Limited, Romford (GB)

( * ) Notice: Subject to any disclaimer, the term of this patent is extended or adjusted under 35 U.S.C. 154(b) by 276 days.

(21) Appl. No.: 09/739,900

(22) Filed: Dec. 20, 2000

(65) Prior Publication Data

US 2001/0020764 A1 Sep. 13, 2001

(30) Foreign Application Priority Data

Dec. 21, 1999 (GB) ..... 9930235

(51) Int. Cl.[7] ..... B41F 1/28
(52) U.S. Cl. ..... 101/407.1
(58) Field of Search ..... 101/407.1, 287; 400/630, 56; 271/226, 234, 235, 236, 241, 243, 245, 248, 250, 251, 9.09

(56) References Cited

U.S. PATENT DOCUMENTS

| | | | | | |
|---|---|---|---|---|---|
| 3,693,543 | A | * | 9/1972 | Noller | 101/287 |
| 4,049,256 | A | * | 9/1977 | Church et al. | 271/9.01 |
| 4,188,025 | A | * | 2/1980 | Gusafson et al. | 271/238 |
| 4,328,066 | A | * | 12/1980 | Brooke | 271/184 |
| 4,541,623 | A | * | 9/1985 | Huerta | 271/235 |
| 4,742,771 | A | * | 5/1988 | Heilig | 101/407.1 |
| 4,775,143 | A | * | 10/1988 | Arnoldi | 271/251 |
| 4,831,273 | A | | 5/1989 | Ross et al. | |
| 4,850,580 | A | | 7/1989 | Denzin et al. | |
| 5,332,210 | A | * | 7/1994 | Silverberg et al. | 271/220 |
| 5,340,100 | A | * | 8/1994 | Romanenko | 271/303 |
| 5,427,025 | A | * | 6/1995 | Lee et al. | 400/56 |
| 5,595,380 | A | * | 1/1997 | McCue, Jr. et al. | 271/9.09 |
| 5,640,903 | A | * | 6/1997 | Salomon | 400/630 |
| 5,694,855 | A | * | 12/1997 | Gardmer | 101/407.1 |
| 5,806,994 | A | | 9/1998 | Coffy et al. | |
| 5,949,444 | A | | 9/1999 | Geserich et al. | |
| 5,975,524 | A | * | 11/1999 | Döpke et al. | 271/236 |

FOREIGN PATENT DOCUMENTS

| | | |
|---|---|---|
| DE | 19605015 | 1/1996 |
| EP | 0405356 | 6/1990 |
| FR | 2742693 | 12/1995 |

* cited by examiner

*Primary Examiner*—Eugene H. Eickholt
(74) *Attorney, Agent, or Firm*—Shoemaker and Mattare

(57) ABSTRACT

Apparatus for retaining a mail piece includes first and second elements, said elements having an open state in which the first element is spaced from said second element for insertion of a mail item therebetween into a required position and a closed state in which at least one of the first and second elements is displaced toward the other of the first and second elements to clamp the mail piece and further including mail piece retention means mounted on the first element and effective during displacement of the element to retain the mail piece in the required position to which it has been inserted.

9 Claims, 3 Drawing Sheets

MAIL RETAINING APPARATUS

BACKGROUND OF THE INVENTION

This invention relates to mail retaining apparatus and in particular to apparatus for retaining a mail piece in a position in which it has been placed for printing a postal indicia thereon.

Postal authorities require that postal indicia are printed in a specified area adjacent an upper right hand corner of mail pieces. Accordingly, in printing devices for printing postal indicia on mail pieces, it is necessary that the mail piece be correctly located relative to a print head to ensure that the postal indicia is printed in the specified area on the mail piece.

In postage metering apparatus intended to handle a relatively small throughput of mail pieces, the mail pieces are inserted manually into the postage metering apparatus and must be correctly located manually relative to a field of the apparatus in which printing is to be effected. Guides provided for engagement by mail pieces are located such that when the mail piece engages the guides, the mail piece is correctly located with the area of the mail piece required to receive the postal indicium imprint aligned with the printing field. Mail detection means is provided to respond to a mail piece being manually located in engagement with the guides and thus to provide an output signal indicating that the specified area on the mail piece for a postage indicium imprint is aligned with the print field of the postage metering apparatus. It will be appreciated that, when the mail piece has been correctly located for printing the postal indicium, the mail piece must be maintained in the correct location until printing of the indicium has been completed. If the mail piece is subjected to displacement away from the correct location thereof prior to commencement of printing the postal indicium will not be printed in the specified location on the mail piece. Also commonly used digital print heads operate in a series of print cycles in each of which cycles dots to form parts of the imprint are printed in selected positions in a series of columns spaced across the print field. Accordingly if any displacement of the mail piece occurs during the series of print cycles, a distorted postal indicium will be printed.

The dimensions of mail pieces may have a substantial range of sizes. Accordingly in order to facilitate location of mail pieces with the upper right hand corner thereof located so as to receive a postal indicium imprint in the specified area thereon a slot for reception of mail pieces is open both to the front and to the left hand side of the postage metering apparatus whereby mail pieces may extend from the slot from the front and from the left hand side of the apparatus. A user of the postage metering apparatus may enter the mail into the slot of the postage metering apparatus from the front, from the left hand side or in any direction therebetween. Our pending unpublished UK patent application No. 9902062.0 describes and claims a mail sensor that responds to correct location of the mail regardless of which of the directions the mail piece is entered into the slot.

In order to ensure correct functioning of the print head a surface of the mail piece that is to receive the postal indicium imprint needs to be located at a required distance from the print head of the postage metering apparatus. Accordingly the mail piece is resiliently urged against a guide so that the postal indicium receiving surface of the mail piece lies in a plane with a predetermined spacing from the print head. Preferably the print head is an ink jet digital print head in which droplets of ink are ejected selectively from nozzles of the print head to the surface of the mail piece however other types of print head may be utilised, for example the print head may be a digital impact print head in which tips of print wires are impacted selectively with an ink ribbon to transfer ink from the ribbon to the surface of the mail piece.

A construction of apparatus for supporting and maintaining a mail piece in a required location relative to a print head is described in our pending UK patent application No. 9902062.0. A mail piece when inserted into the postage metering apparatus is supported by a platform and the platform is resiliently urged toward an apertured guide plate so that the postal indicium receiving surface of the mail piece is located in engagement with the guide plate at a required spacing from the print head. The resilient urging of the platform toward the guide plate, with the mail piece located between the platform and the guide plate, serves to clamp the mail piece. The platform is displaceable to an open position in which the platform is spaced from the guide plate by a distance sufficient to permit entry of a mail piece between the platform and the guide plate and to permit removal of a mail piece therefrom. When a mail piece has been entered between the platform and guide plate and the mail piece is correctly located in engagement with the guides, the mail sensing means outputs a signal and, in response to this signal, the platform is urged toward the guide plate by resilient means thereby clamping the mail piece between the platform and the guide plate.

It will be appreciated that the mail piece may be entered between the platform and guide plate and be correctly located in engagement with the guides so that the mail sensing means output signal initiates the urging of the platform toward the guide plate but, before the mail piece has been clamped between the platform and the guide plate, the mail piece accidentally may be displaced from the correct location thereof. As a result the mail piece will be clamped in a location displaced from the correct location and the imprint of the postal indicium will be incorrectly located on the mail piece. Therefore the present invention provides means resisting displacement of the mail piece after the mail piece has been correctly located at least until the mail piece has been secured by clamping between the platform and the guide plate.

SUMMARY OF THE INVENTION

According to the invention apparatus for retaining a mail piece includes first and second clamp elements, said clamp elements having an open state in which the first clamp element is spaced from said second clamp element for insertion of a mail item therebetween into a required position in which a predetermined part of the mail piece is located at a predetermined location and a closed state in which at least one of said first and second clamp elements is displaced toward the other of said first and second clamp elements to clamp the mail piece and further including mail piece retention means mounted on said first clamp element and effective during displacement of said at least one clamp element to retain said mail piece in said required position to which it has been inserted.

BRIEF DESCRIPTION OF THE DRAWING

An embodiment of the invention will now be described by way of example with reference to the drawings in which.

DESCRIPTION OF THE PREFERRED EMBODIMENT

Figure 1:
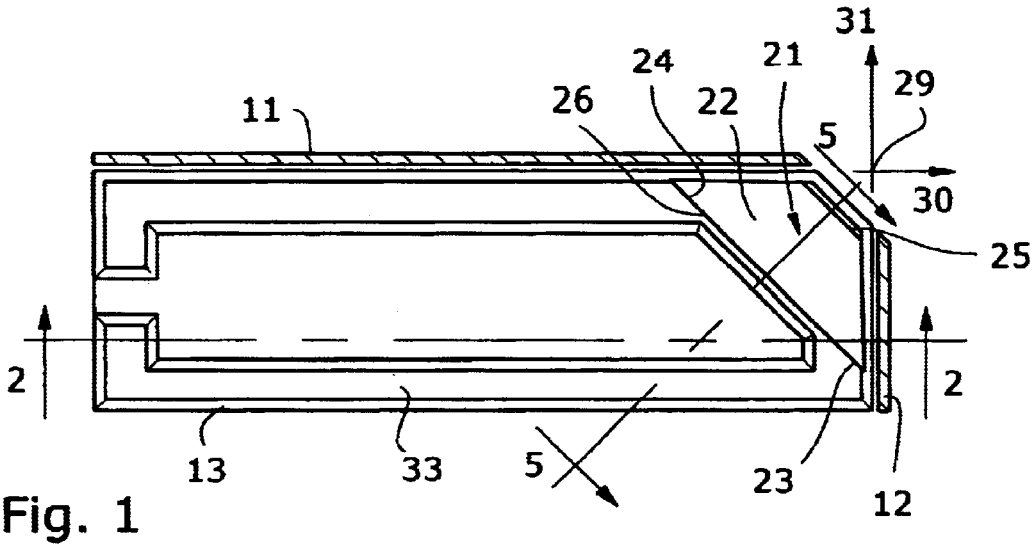
FIG. 1 is a horizontal sectional view of a mail receiver and sensor of a postage meter on a line 1—1 of FIG. 2.
Figure 2:
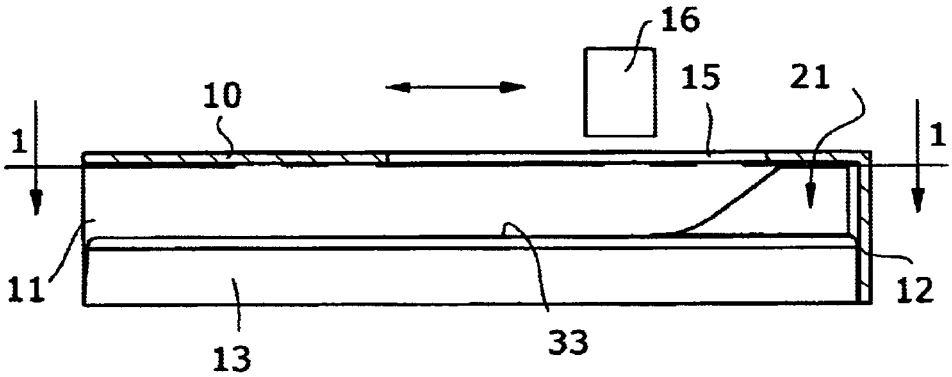
FIG. 2 is a view partly in section on the line 2—2 of FIG. 1 of the mail receiver.
Figure 3:
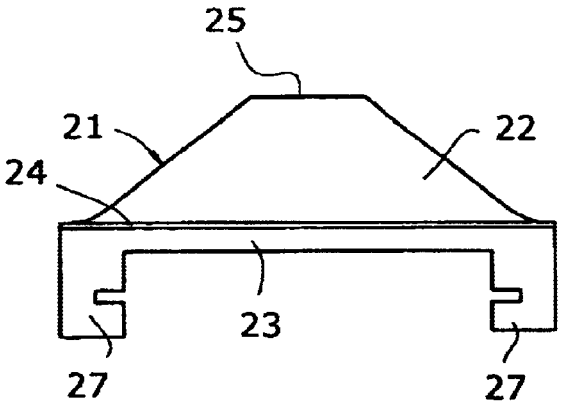
FIG. 3 is a front elevation of a mail piece retaining spring.

Referring to the drawings and in particular to FIGS. 1, 2, 6 and 7, a mail receiver of a postage meter includes a clamp plate 10 from which an upper edge guide wall 11 and a right side edge guide wall 12 extend. The guide walls 11 and 12 extend in mutually perpendicular first and second planes 30, 31 respectively. A mail support and clamping platform 13 extends below the clamp plate 10 has a substantially planar mail engaging surface 33 and is movable between open and closed positions. In the open position as shown in FIG. 2 the platform is in a lowermost position spaced from the plate 10 to permit the entry between the platform and the plate 10 of a mail piece 14 to receive a postal indicium imprint and to permit the removal of the mail piece after receiving the imprint. In the closed position, the platform is urged toward the plate 10 so that the mail piece is pressed by the platform against the plate 10 and clamped between the surface 33 of the platform and the plate 10. The platform is urged resiliently toward the closed position preferably by compression springs (not shown) and is displaced to the open position by a drive mechanism (not shown) operated by the postage meter. A drive mechanism for effecting displacement of the platform between closed and open positions is disclosed in our pending UK patent application No. 9902062.0 and the disclosure thereof is incorporated herein. The resilient urging of the platform toward the plate enables mail pieces having a range of thicknesses to be accommodated while ensuring that the surface of the mail piece, on which the postal indicium is to be printed, is maintained in engagement with the clamp plate 10.

The clamp plate 10 has an aperture 15 therein and a digital print head 16 is traversed to scan a print field that extends within the aperture 15. The plate 10 is spaced from the print head 16 by a distance such that, with the mail piece urged against the plate, the surface of the mail piece adjacent the plate is located at a predetermined operational spacing from the print head.

Figure 7:
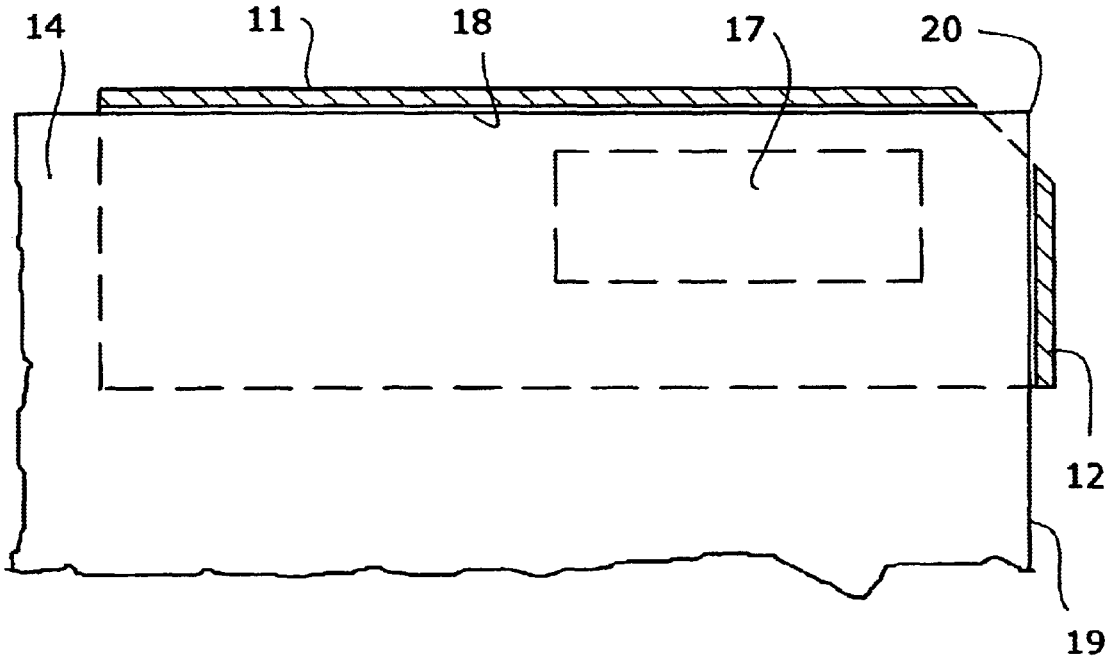
FIG. 7 illustrates location of the mail piece in the mail receptor.

Postal authorities specify a location on the mail piece of an area 17, adjacent an upper right hand corner of the mail piece, in which a postal indicium is to be printed. Accordingly the print field f the print head 16 is located such that, when an upper edge 18 of the mail piece lies in engagement with the upper edge guide wall 11 and a right hand edge 19 of the mail piece lies in engagement with the right hand edge guide wall 12 as shown in FIG. 7, the area 17 is co-extensive with, or extends within the extent of, the print field.

In order that the postal indicium is printed in the specified print field of the mail piece, it is necessary to ensure during the printing of the indicium on the mail piece that the mail piece is correctly located in the mail receiver and is maintained correctly located with the upper edge 18 in engagement with the guide wall 11 and with the right hand edge 19 in engagement with the guide wall 12. This required location of the mail piece in the receiver may be determined by detecting that a corner 20 of the mail piece at an intersection of the upper edge 18 and the right edge 19 is located at a location 29 of an intersection between the planes 30, 31 in which the guide wall 11 and the guide wall 12 respectively extend. A sensor, not shown, is located to detect the presence of the corner 20 of the mail piece at the intersection 29. A construction of sensor is disclosed in our pending UK patent application No. 9902062.0 and the disclosure thereof is incorporated herein.

Mail pieces may have a range of dimensions and hence the mail receiver is open for receipt of mail either from a front of the receiver opposite the guide wall 11 or from a side of the receiver opposed to the guide wall 12 and when the upper right hand part of the mail piece containing the print field 17 is located in the receiver, a remainder of the mail piece extends away from the guide walls 11 and 12 beyond the extent of the plate 10 and the platform 13. Accordingly during insertion manually of a mail piece 14, the mail piece may be moved in the first direction 30 aligned with the guide wall 11, in the second direction 31 aligned with the guide wall 12 or in a direction intermediate the first and second directions such that the mail piece has components of movement in both the first and second directions.

The guide walls 11 and 12 act as guides for the mail pieces during manual entry of the mail pieces into the mail receiver. Also as described hereinbefore the guide walls 11, 12 define locations at which the upper edge 18 and right hand edge 19 of the mail piece must be located for the mail piece to be correctly positioned for receipt of the postal indicium imprint.

It will be appreciated that during manual entry of the mail piece into the mail receiver the mail piece may be moved manually into the required correct location in which the upper edge 18 of the mail piece is in engagement with the guide wall 11 and the right hand edge 19 of the mail piece is in engagement with the guide wall 12 and the corner 20 of the mail piece is located at the location 29 but that, subsequently prior to the mail piece being clamped between the platform and the plate 10, the mail piece may be subject to displacement away from the required correct location. Such displacement may be accidental and due to a number of causes. For example the user of the postage meter may release their grip on the mail piece and in so doing displace the mail piece, the mail piece may be accidentally knocked after release of the manual grip on the mail piece or displacement of the platform, on which the mail piece is supported, from the open to closed position may result is displacement of the mail piece. Therefore, in accordance with the present invention, means effective to inhibit displacement of the mail piece away from the correct location and to urge the mail piece into the correct location during displacement of the platform from the open to the closed mail clamping position is provided.

Figure 4:
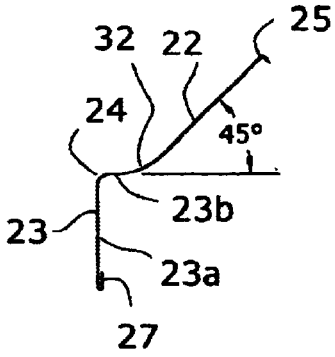
FIG. 4 is a side elevation of the retaining spring

The means to inhibit displacement of the mail piece preferably comprises a mail retention leaf spring 21 and the construction and operation thereof will now be described with reference to FIGS. 3, 4, 5*a*, 5*b* and 5*c*. The leaf spring 21 is constructed of thin resilient sheet material and comprises a leaf element 22 of generally trapezoidal form extending from a base element 23. The leaf element 22 has a free end 25 remote from the base element 23. The base element 23 of the leaf spring 21 has a bend along a line 24 such that the base element has portions 23*a* and 23*b* at an angle of approximately 90° to each other. The base part 23*a* is mounted in a slot 26 in the platform. The slot extends in the platform at an angle to the planes 30, 31 of the guide walls 11 and 12 respectively and preferably extends at approximately 45° to the planes 30, 31 of the guide walls 11 and 12. Therefore as shown in FIG. 1, when the leaf spring is mounted on the platform, the line 24 of the leaf spring 21 extends at an angle to the planes 30, 31 of the guide walls 11 and 12 respectively and, if the slot is at approximately 45°, the line 24 extends at approximately 45° to the planes 30, 31 of the guide walls 11 and 12. The portion 23*b* of the base element extends adjacent to the mail engaging surface 33 of the platform 13. The leaf element 22 extends from the base element 23 toward the location 29 of the intersection of the first and second planes 30, 31 of the guide walls 11 and 12 respectively. The sheet material at the junction between the leaf element 22 and base part 23*b* is formed to have an arcuate profile at 32, as shown in FIG. 4, adjacent the line 24 such that, when the platform is in the open position and no mail is in the receiver, the leaf element extends at an angle of approximately 45° from the surface 33 of the platform 13. However it is to be understood that the leaf element extend at angles other than 45°. The base part 23 includes tabs 27 extending therefrom. The tabs extend through apertures in the platform and are bent to thereby retain and secure the base part in the slot of the platform.

Figure 5A:
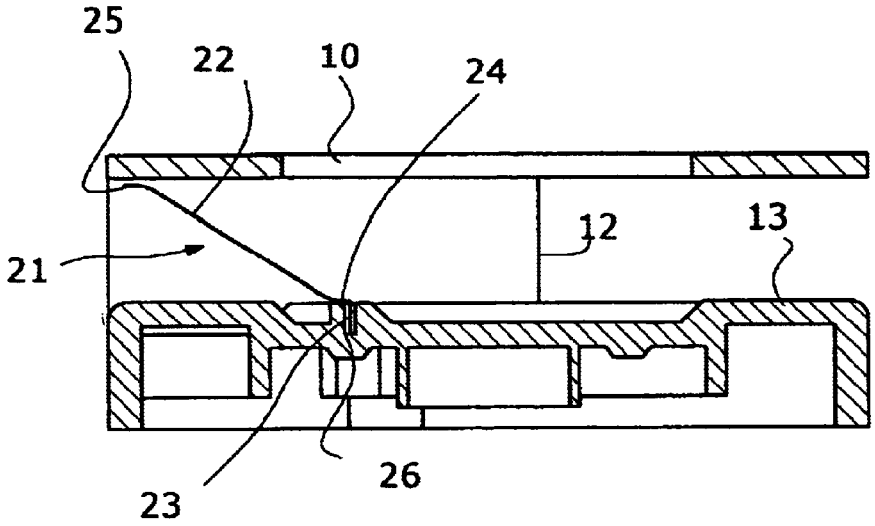
FIGS. 5*a*, 5*b*, 5*c* are sectional views on the line 5—5 of FIG. 1 illustrating insertion and clamping of a mail piece.
Figure 5B:
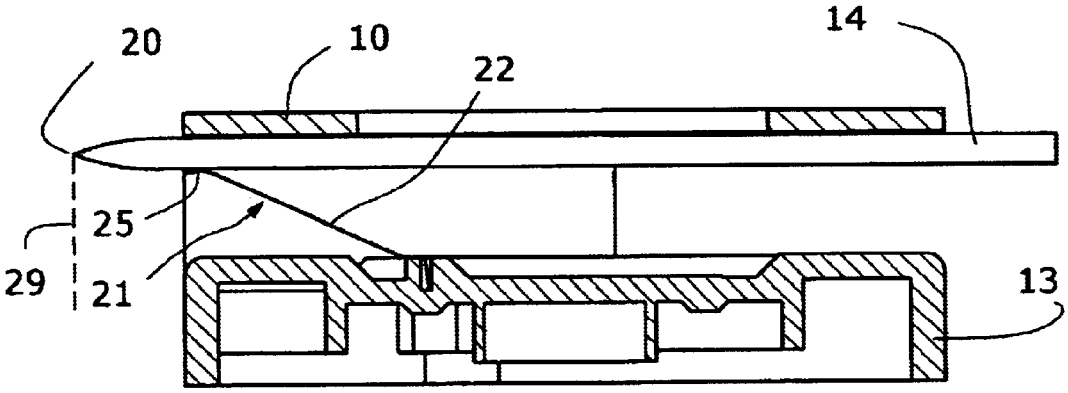
Figure 5C:
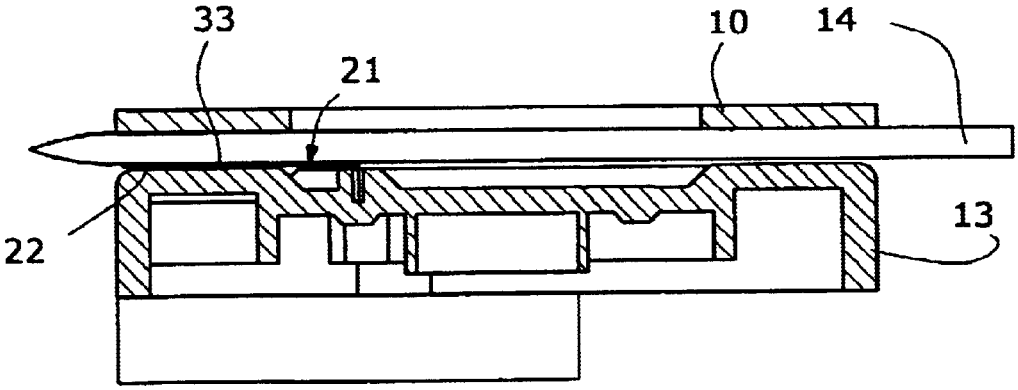
Figure 6:
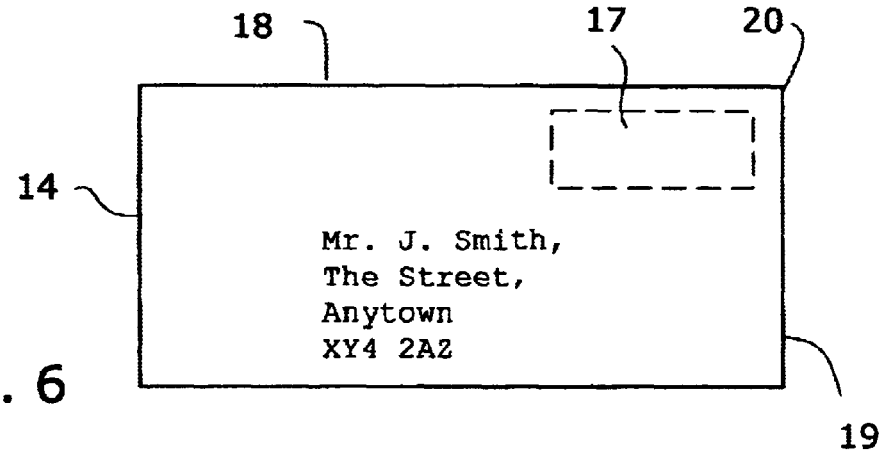
FIG. 6 illustrates a mail piece with an area for a postal indicium.

FIGS. 5*a*, 5*b* and 5*c* illustrate the displacement of the platform after entry of a mail piece and the operation of the mail retention leaf spring 21. In FIG. 5*a*, the platform 13 is in the open position and the leaf element 22 extends to the guide plate 10. When a mail piece 14 is entered manually between the platform and the plate 10, a leading part of the mail piece comes into engagement with the leaf element 22 of the leaf spring 21 and slides along the leaf element until the mail piece engages the plate 10. Further movement of the mail piece then results in the mail piece displacing the leaf element toward the platform and entering between a free end 25 of the leaf element 22 and the plate 10 into a location in which the edges of the mail piece are in engagement with the guide walls and the mail piece is resiliently pressed against the plate 10 by the leaf element 22 as shown in FIG. 5*b*. When the mail piece extends between the leaf element 22 and the plate 10, the mail piece is resiliently engaged by the free end 25 of the leaf element 22 and this resilient engagement tends to retain the mail piece in the position at which it has been placed manually. It will be appreciated that with the disposition of the leaf element 22 as described hereinbefore the leaf element is inclined in the direction of movement of the mail piece, when the mail piece is entered between the platform and the plate 10, regardless of the direction in which the mail piece is entered into the receiver. The leaf element is displaced relatively easily by the mail piece to facilitate movement of the mail piece into the required correct position engaging the guide walls. However any tendency of the mail piece to move in an opposite direction away from the required correct position will be inhibited by the leaf 22 because any frictional force between the leaf spring and the mail piece will act on the leaf such as to enhance the spring force and thereby increase the frictional force acting on the mail piece. After insertion of the mail piece into the required correct position, the platform is displaced from the open position toward a closed position as shown in FIG. 5*c* in which the mail piece is clamped and retained between the platform and the plate 10. This displacement of the platform results in the leaf element 22 being depressed to lie on the surface 33 of the platform and a consequence is that during depression of the part 23 of the leaf the free end 25 thereof moves toward the location 29 of the intersection of the first and second planes of the guide walls thereby applying a force on the mail piece toward the location 29. This force applied on the mail piece tends to urge the mail piece into engagement with the guide walls. Therefore during displacement of the platform from the open position to the closed clamping position, if the mail piece is in engagement with the guide walls, the mail piece is maintained in engagement with the guide walls 11, 12 or, if the mail piece has been slightly displaced, the mail piece is urged toward the guide walls into the required correct location. In addition the force applied to the mail piece by the leaf element 22 as a result of the movement of the free end of the leaf element toward the location 29 during displacement of the platform from the open position to the closed clamping position further resists any tendency of the mail piece to move away from the required correct position. When the mail piece is clamped by the platform being displaced to the closed clamping position, although the leaf element 22 exerts a force on the mail piece, this force is relatively insignificant compared with the clamping force applied by the platform on the mail item and retention of the mail item in the required position for printing of the postal indicium substantially is due to the clamping force exerted on the mail piece by the platform. While the mail piece is retained by the clamping action of the platform, the print head is operated to print a determined postal indicium on the mail piece. After printing of the postal indicium is completed, the platform is displaced to the open position thereby unclamping the mail piece and permitting the mail piece to be withdrawn from between the platform and the plate 10. Although the leaf spring 22 tends to resist withdrawal of the mail piece, the action of the leaf spring is overcome by a positive manual withdrawal force. The free end 25 of the leaf spring is radiused to be of arcuate profile as shown in FIG. 4 so that the free end 25 presents a rounded convex surface for engagement with the mail piece.

Preferably the leaf element 22 of the leaf spring is of sufficiently small thickness that when depressed to lie against the surface of the platform it does not significantly affect the clamping of the mail pieces by the platform. In a preferred construction of leaf spring, the leaf spring is constructed of stainless steel sheet having a thickness of approximately 0.08 mm. However if desired the leaf spring may be greater thickness and the surface of the platform may be recessed to accommodate the leaf 22 when the leaf is depressed against the platform.

It will be appreciated that in depression of the leaf element 22 the portion 32 of arcuate profile will flatten against the surface of the platform and the leaf element will in effect pivot about an axis in the region of the portion 32 that is parallel to the line 24.

If desired, the base element 23 may comprise only the part 23*a* and the leaf element extend from the line 24 in which case, in depression of the leaf element, the leaf element will pivot about an axis aligned with or immediately adjacent to the line 24 along which the leaf spring is bent.

Hereinbefore, the platform 13 has been described as being displaced toward and away from the plate 10. However if desired the platform may remain stationary and the plate be displaced to clamp and unclamp the mail pieces or both the platform and the plate may be displaceable relative to one another.

We claim:

1. An apparatus for retaining a mail piece including:

first and second elements, the first and second elements having an open state in which the first element is spaced from the second element for insertion of a mail item therebetween into a required position in which a corner of the mail piece is located at a predetermined location and a closed state in which at least one of the first and second elements is displaced toward the other of the first and second elements to clamp the mail piece;

corner location means for locating a corner of the mail piece at the predetermined location; and mail piece retention means mounted on the first element and effective during displacement of the at least one element to retain the mail piece in the required position.

2. An apparatus as claimed in claim 1, wherein the mail piece retention means is to apply a force on the mail piece in a direction toward the predetermined location during displacement of the at least one element, such as to urge the corner of the mail piece to the predetermined location.

3. An apparatus as claimed in claim 1, wherein the mail piece includes first and second edges adjoining the corner thereof, the corner location means includes first and second guide means engaged respectively by the first and second edges of the mail piece when the corner of the mail piece is located at the predetermined location, and the mail piece retention means includes a mail piece retention member resiliently pivotable about an axis adjacent the first element and extending from the axis toward the second element in a direction toward the predetermined location, the axis extending at an angle inclined both to the first and second guide means.

4. An apparatus as claimed in claim 3, wherein the axis is inclined at an angle of approximately 45°.

5. An apparatus as claimed in claim 1, wherein the mail piece retention means comprises a leaf spring having a leaf element and a base element, the base element being secured to the first element.

6. An apparatus as claimed in claim 3, wherein the mail piece retention means comprises a leaf spring having a leaf element and a base element, the base element being secured to the first element and the leaf element and the base element being integral and adjoined along the axis.

7. An apparatus as claimed in claim 6, wherein the first element includes a substantially planar support surface for engaging the mail piece and the base element of the leaf spring includes a part extending parallel to and adjacent the planar support surface.

8. An apparatus as claimed in claim 7, wherein the leaf spring comprises a portion of arcuate section between the base element and the leaf element thereof.

9. An apparatus as claimed in claim 8, wherein the leaf element of the leaf spring extends at an angle of approximately 45° to the planar support surface.

* * * * *